United States Patent [19]

Nagayama

[11] Patent Number: 4,816,870

[45] Date of Patent: Mar. 28, 1989

[54] DEVELOPING DEVICE FOR COPIER AND OTHERS

[75] Inventor: Masanori Nagayama, Tokyo, Japan

[73] Assignee: Ricoh Company, Ltd., Tokyo, Japan

[21] Appl. No.: 125,862

[22] Filed: Nov. 27, 1987

[30] Foreign Application Priority Data

Dec. 2, 1986 [JP] Japan ..... 61-287494

[51] Int. Cl.[4] ..... G03G 15/08

[52] U.S. Cl. ..... 355/3 DD; 355/14 D

[58] Field of Search ..... 355/4, 3 DD, 14 D; 118/645, 657, 658

[56] References Cited

U.S. PATENT DOCUMENTS 4,303,331 12/1981 Thompson ..... 355/3 DD

FOREIGN PATENT DOCUMENTS 58-163969 9/1983 Japan ..... 355/3 DD
60-153068 8/1985 Japan ..... 355/3 DD
60-153070 8/1985 Japan ..... 355/3 DD
61-210372 9/1986 Japan ..... 355/3 DD

*Primary Examiner*—A. C. Prescott
*Assistant Examiner*—Jane Lau
*Attorney, Agent, or Firm*—Oblon, Fisher, Spivak, McClelland & Maier

[57] ABSTRACT

One or each of a plurality of developing units of a magnetic brush type developing device includes a shield plate which is angularly movable in a space between a cylindrical sleeve, which constitutes a developing roller, and a magnetic body so as to shield a part of magnetic fields which are developed by the magnetic body. The shield plate moves in a reciprocal motion only between a first position corresponding to that where the sleeve scoops a developer and a second position where the developer is separated and not to a position where a main pole magnet for development of the magnetic body is disposed, so that a magnetic field developed by the main pole magnet is not shielded. A member for supporting the shield plate is interposed between the magnetic body and the shield plate.

22 Claims, 6 Drawing Sheets

DEVELOPING DEVICE FOR COPIER AND OTHERS

BACKGROUND OF THE INVENTION

The present invention relates to a developing device for an electrophotographic copier and others and, more particularly, to a magnetic brush type multiple color developing device for twin-color, multi-color or full-color development which includes a plurality of developing units each having a developing roller or a magnetic brush type developing device which effects development with a wide range of tones by using toner of a single color.

In a multiple color developing device, for example, a plurality of developing units each storing toner of a different color are arranged in close proximity to a photoconductive element which serves as a latent image carrier. Development is repeated a plurality of times with the toner of different colors to produce a final color image. Among such developing devices, one which uses a magnetic brush includes a developer carrier which is installed in each developing unit for forming the magnetic brush. The developer carrier is usually implemented with a developing roller which is made up of a cylindrical sleeve, and a magnetic body received in the sleeve for forming the magnetic brush. At least one of the sleeve and magnetic body is rotated to transport a magnetic brush between a toner supply region and a developing region. The developing units are selectively operated on a color basis. Specifically, while any one of the developing units is in operation, the others are maintained inoperative and, thereby, prevented from supplying toner to a latent image which is provided on the photoconductive drum.

However, it sometimes occurs that even when a developing unit which does not join in development is held inoperative, toner deposited on the developing roller of that developing unit makes contact with a latent image to be transferred to the latter. The disturbs the reproduction of colors resulting in mixture of colors.

Various schemes have heretofore been proposed to solve the above-stated problem. Those schemes include one which causes only the developer carrier to move in a reciprocal motion (Japanese Laid-Open Patent Publication (Kokai) No. 50-151532/1975 etc.), one which allows a blade to move into and out of contact with the developer carrier (Japanese Laid-Open Patent Publication (Kokai) No. 50-151530/1975 etc.), one which selectively rotates the developing sleeve in opposite directions (Japanese Laid-Open Patent Publication (Kokai) No. 50-93438/1975 etc.), one which angularly moves, or rotates, the magnets which are installed in the developer carrier (Japanese Laid-Open Patent Publication (Kokai) No. 52-105832/1977 etc.), and one which includes a shutter device located between the developer carrier and the latent image carrier (Japanese Laid-Open Utility Model Publication (Kokai) No. 52-152742/1977). All such prior art schemes, however, lack simplicity and sureness.

On the other hand, Japanese Laid-Open Utility Model Publication No. 60-39053/1985 discloses a developing device in which a shield member is located in a space between a cylindrical developing sleeve which neighbors a latent image carrier in a form of drum and a magnetic body (magnet roll) which is received in the sleeve. The shield member is rotatable to change the magnetic force distribution on the sleeve by shielding the magnetic field which is developed by the magnet roll, whereby the timing of developer supply to the sleeve is controlled. What should be noted in this prior art developing device is that the shield member is rotated along the above-stated space to shield even the magnetic field which is developed by a main pole magnet of the magnet roll that faces a photoconductive element. In such a construction, a sufficient space should be available between the shield member and the magnetic roll and between the sleeve and the shield member, not to speak of the space between the sleeve and the magnet roll.

On the other hand, the wall of the sleeve has to be thinned as far as possible so that sufficient magnetic forces may be developed on the sleeve. For example, in the above-described prior art device, when the wall thickness of the sleeve is as thin as 0.8 to 1 millimeter, the spacing available between the inside diameter of the sleeve and the outside diameter of the magnet roll is not more than 2 to 2.5 millimeters at maximum. Hence, the device has inevitably be configured such that the distance between the shield member and the inside diameter of the sleeve is about 0.5 millimeter, the thickness of the shield member is about 1 millimeter, and the distance between the shield member and the outside diameter of the magnet roll is about 1 millimeter.

Therefore, a problem with this type of developing device is that when the shield member is implemented with an extensively usable cold-rolled steel sheet, it is deformed at an intermediate point of its lengthwise dimension (about 350 millimeters) tending to make contact with the magnet roll. The magnetic force exerted by the magnet roll to deform the shield plate so is generally inversely proportional to the distance between the shield member and the magnet roll. It follows that in a developing device in which a sufficient spacing is unavailable between the shield member and the magnet roll due to its inherent structure, the shield plate is deformed by the magnetic force into contact with the magnet roll resulting that the load in the event of rotating the shield plate is increased to damage a support for the shield plate or disturb the rotation of the shield plate.

Further, in this prior art developing device, the sleeve, magnet roll and shield member are each cantilevered by using a great number of support members. Tolerances of such numerous support members would accumulate to lower the accuracy of a predetermined gap which is defined between the photoconductive element and the developing sleeve, while causing the sleeve to oscillate due to the instability of an axis.

In addition, in a prior art developing device of the type described, the end portion of the shield member and a shield member drive portion for rotating the shield member are integrated by a relatively thick flange (a sufficiently thick flange is indescribable for cantilever type support). For this reason, the width of the sleeve is far greater than that of the magnet roll so that it fails to be matched with those of the other structural elements such as the photoconductive element. This obstructs the common application of drive shafts, brackets and other parts and, thereby, invites an increase in cost.

SUMMARY OF THE INVENTION

It is, therefore, an object of the present invention to provide a developing device capable of adjusting surely and, yet, with a simple construction the intensity of magnetic fields developed by a magnetic body and the amount of toner to be scooped up.

It is another object of the present invention to provide a multiple color developing device capable of eliminating mixture of different colors by adjusting surely and, yet, with a simple construction the intensity of magnetic fields developed by a magnetic body for forming a magnetic brush and the amount of toner to be scooped.

In accordance with the present invention, a device disposed in close proximity to a latent image carrier of an image forming apparatus for carrying a developer which constitutes a magnetic brush, comprises a cylindrical sleeve for supporting the magnetic brush on outer periphery of the cylindrical sleeve, magnetic field developing means disposed in the sleeve for developing magnetic fields for forming the magnetic brush, and a shield member located in a space which is defined between the sleeve and the magnetic field developing means such that the shield member is movable in a reciprocal motion between a first position which corresponds to that where the sleeve scoops the developer and a second position which corresponds to that where the developer is separated, the shield member shielding a part of the magnetic fields at the first and second positions.

The above and other objects, features and advantages of the present invention will become more apparent from the following detailed description taken with the accompanying drawings.

DESCRIPTION OF THE PREFERRED EMBODIMENTS

Figure 1:
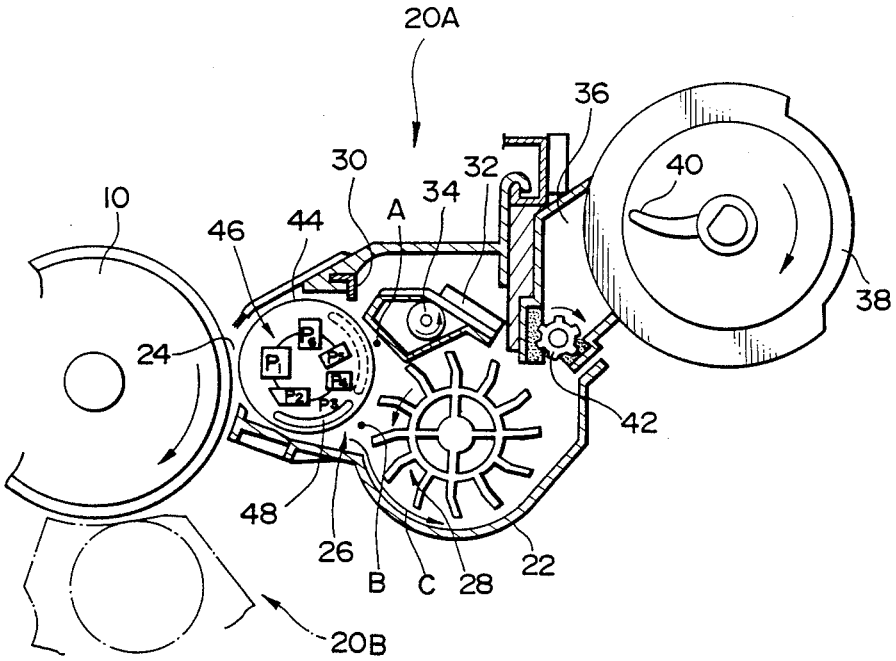
FIG. 1 is a sectional elevation of a developing device embodying the present invention.

Referring to FIG. 1 of the drawings, a developing device embodying the present invention is shown which is applied to a twin-color copier by way of example. As shown, the developing device includes a first developing unit 20A and a second developing unit 20B which are arranged around a photoconductive drum 10, which serves as a latent image carrier of the copier. While the developing units 20A and 20B are identical in construction, each of them stores toner of a different color.

The developing unit 20A, for example, includes a casing 22 which is provided with an opening 24 at its front end. A developing roller 26 for carrying a developer is journalled to the casing 22 in such a manner as to close the opening 24. A paddle roller 28 is a scooping means disposed at the rear of the developing roller 26 to scoop up toner to supply it to the developing roller 26 while agitating it. The paddle roller 28 is driven in a rotary motion by a driving mechanism, not shown. Specifically, the driving mechanism for the paddle roller 28, like the one assigned to a magnetic shield plate which will be described, includes a mechanical or an electromagnetic clutch mechanism which is operable to start and stop the rotation of the roller 28. Upon the stop of rotation of the paddle roller 28, the supply of toner to the developing roller 26 is interrupted.

A doctor blade 30 is located above the developing roller 26 to regulate toner on the developing roller 26 to a predetermined thickness. Positioned in the vicinity of the doctor blade 30 are a separator 32 and a transport screw 34 which are adapted to agitate toner scraped off by the doctor blade 30. A toner hopper 36 is formed integrally with and at the rear of the casing 22. A toner cartridge 38 is detachably mounted in the toner hopper 36. The toner cartridge 38 stores a predetermined amount of toner therein and includes an agitator 40 for transporting the toner toward the toner hopper 36 while agitating it. Disposed in the toner hopper 36 is a toner supply roller 42 which serves to feed toner to the casing 22 by a predetermined amount at a time.

Figure 2:
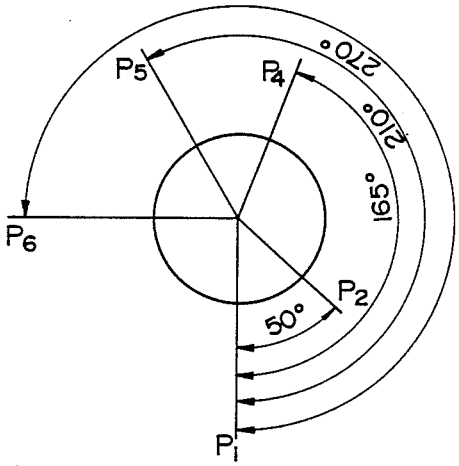
FIG. 2 is a schematic diagram showing positions of magnets which constitute a magnetic body.

The developing roller 26 is made up of a cylindrical sleeve 44, and a magnetic body 46 which is arranged in and along the circumference of the sleeve 44. By magnetic fields developed by the magnetic body 46, a magnetic brush is formed on the periphery of the sleeve 44. The magnetic body 46 comprises a plurality of magnets $P_1$, $P_2$, $P_4$, $P_5$ and $P_6$ which are arranged in this order from a developing station in the counterclockwise direction as viewed in FIG. 1. The magnets $P_1$, $P_2$, $P_4$, $P_5$ and $P_6$ are located at angular positions which are shown in FIG. 2 by way of example. In FIG. 2, the magnet $P_2$ is located at an angular distance of 50 degrees from the magnet $P_1$, the magnet $P_4$ is located at an angular distance of 156 degrees from the magnet $P_1$, the magnet $P_5$ is located at an angular distance of 210 degrees from the magnet $P_1$, and the magnet $P_6$ is located at a distance of 270 degrees from the magnet $P_1$. While the magnet $P_1$ constitutes a main pole magnetic, or developing magnet, the magnets $P_2$, $P_4$, $P_5$ and $P_6$ each constitutes an auxiliary pole magnet. Among them, the magnets $P_4$ and $P_5$ are adapted to develop toner scooping magnetic fields which will be described.

A magnetic shield plate 48 is interposed between the magnetic body 46 and the sleeve 44 in order to selectively shield the magnetic fields which are developed by the auxiliary pole magnets $P_2$, $P_4$ and $P_5$. Constituted by a flat magnetic sheet, the shield plate 48 has a predetermined length and is bent to have a predetermined radius of curvature. The shield plate 48 extends over a predetermined width of the sleeve 44 along the axis of the latter. Further, the shield plate 48 is rotatably supported coaxially with the sleeve 44 to be movable along the inner periphery of the sleeve 44.

When the shield plate 48 is angularly moved to a position between the magnets $P_2$ and $P_4$ at which toner remaining on the magnetic brush after development is let fall, i.e., to a residual toner separating position, and then stopped to cover that position represented by a solid line in FIG. 1, it serves as a magnet $P_3$ for causing the toner to fall. Specifically, as toner reaches a region just below the shield plate 48 after development, it is let fall by gravity due to the shielding effect of shield plate 48. The shield plate 48 is also movable to a position where it covers the magnets $P_4$ and $P_5$ (represented by a dashed line in FIG. 1) and where toner normally begins to be deposited on the sleeve 44, i.e. to a position corresponding to a toner scooping position of the developing roller. When the shield plate 48 is moved to the toner scooping position, it shields the toner scooping magnetic fields developing by the magnets $P_4$ and $P_5$ to thereby interrupt the deposition of toner on the sleeve 44.

Figure 3:
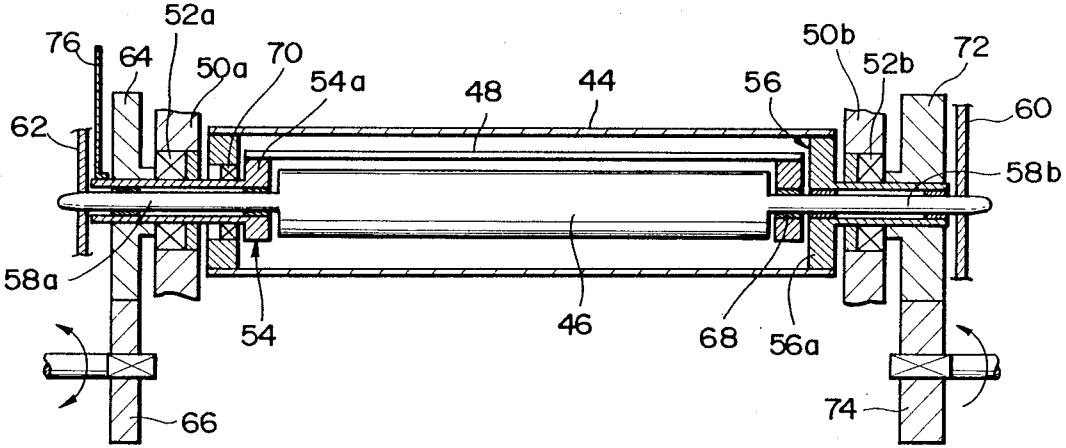
FIG. 3 is a section showing a developing roller which serves as a developer carrier and a system for driving the developing roller which are included in the device of FIG. 1.

As shown in FIG. 3, the sleeve 44 and the shield plate 48 are journalled to opposite side walls **50*a* and 50*b* of the casing 22 coaxially with each other. Specifically, a hollow first drive shaft 54 is rotatably supported by the casing side wall 50*a* through a bearing 52*a* while a hollow second drive shaft 56 is rotatably supported by the other casing side wall 50*b* through a bearing 52*b*. Opposite shaft portions 58*a* and 58*b* of a magnet holder which is adapted to hold the magnetic body 46 extend through the hollow drive shafts 54 and 56, respectively, and securely supported by plates 60 and 62**, respectively.

A flange **54*a* extends radially outward from the inner end of the first drive shaft 54, one end of the shield plate 48 being connected to the flange 54*a*. A driven gear 64 is mounted on the outer end of the drive shaft 54 while a drive gear 66 is held in constant mesh with the driven gear 64. The drive gear 66 is rotated by a motor, not shown, to in turn angularly move the shield plate 48 along the inner periphery of the sleeve 44. The motor mentioned above is implemented with a DC motor having a relatively large torque, a DC motor having a great speed reduction ratio, or a stepping motor. A stepping motor, for example, is selectively rotated in the forward and reverse directions to move the shield plate 48 between the previously stated remaining toner separating position and toner scooping position. A stepping motor alone is capable of positioning the shield plate 48** with sufficient accuracy because an allowance of ± several degrees is available.

The other end, or right end as viewed in FIG. 3, of the shield plate 48 is rotatably supported by the magnetic holder shaft portion **58*b* through a bearing 68. The sleeve 44 is fixed at its one end to a radially outwardly extending flange 56*a* of the second drive shaft 56 and supported at the other end by the first drive shaft 54 through a bearing 70. The sleeve 44 is rotated by a drive gear 74 and a driven gear 72 which are associated with the second drive shaft 56, the gears 74 and 72** being constantly meshed with each other.

Figure 4:
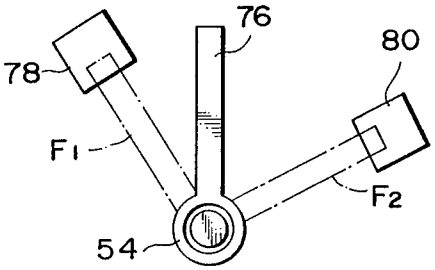
FIG. 4 is a view showing a feeler of FIG. 3 in different positions.

Further, an arm-like feeler 76 which serves as stopping means is mounted on the outer end, or left end as viewed in FIG. 3, of the first drive shaft 54. Rotatable integrally with the drive shaft 54, the feeler 76 is movable over the same angular range as the shield plate 48. Position sensors 78 and 80 are located in positions which correspond to, respectively, opposite maximum angular positions $F_1$ and $F_2$ of the feeler 76 which are represented by dash-and-dot lines in FIG. 4. Implemented with a photointerrupter or the like, each of the position sensors 78 and 80 is responsive to a different one of the maximum angular positions $F_1$ and $F_2$.

Figure 5:
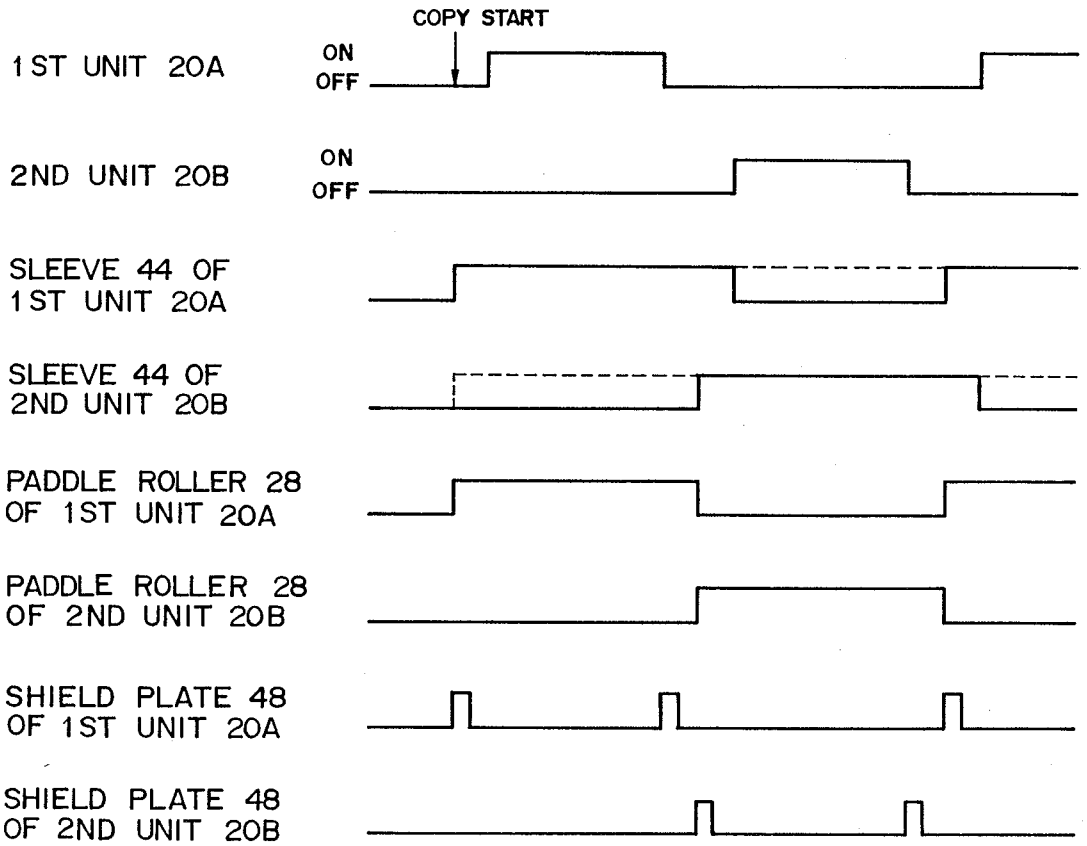
FIG. 5 is a timing chart demonstrating an exemplary developing operation of the device as shown in FIG. 1.

The developing device having the above construction may be operated as shown in FIG. 5 by way of example. Specifically, in response to a start signal, the paddle roller 28 and the sleeve 44 of the developing roller 26 which are installed in the first developing unit 20A begin to be rotated. This causes the toner in the casing 22 to be scooped up by the paddle roller 28 while being agitated, resulting that the toner is deposited on the sleeve 44 for development. An arrangement is made such that the sleeve 44, paddle roller 28 and screw 34 begin to be driven immediately before the start of development (e.g. 2 seconds before the start of development). Meanwhile, the paddle roller and sleeve of the second developing unit 20B are held in a halt and, therefore, development by the unit 20B is not effected.

Figure 6:
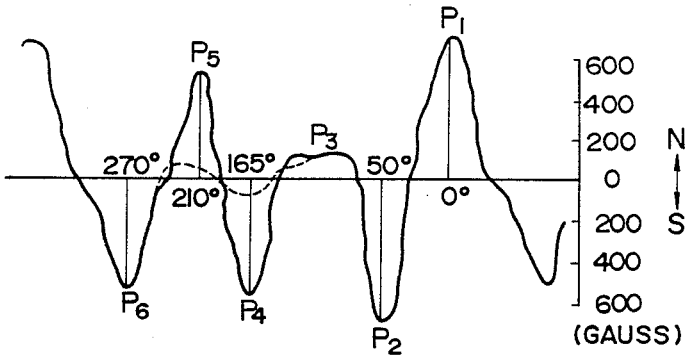
FIG. 6 is a chart representative of a magnetic field intensity distribution which is developed by the magnets of the magnetic body as shown in FIG. 1.

In the above condition, the shield plate 48 of the first developing unit 20A is maintained in the residual toner separating position at which toner is to fall (solid line position of FIG. 1) while, at the same time, the shield plate 48 of the second developing unit 20B is located at the toner scooping position at which the deposition of toner is to begin (dashed line position of FIG. 1). At this instant, therefore, the magnetic field intensity in the developing roller 26 of the developing unit 20A is distributed as, for example, represented by a solid line in FIG. 6. Specifically, the toner is deposited on the developing roller 26 by the magnetic fields which are developed by the magnets $P_4$ and $P_5$ while, at the same time, the toner remaining after development is let fall by the shield plate 48, i.e. magnet $P_3$. As regards the developing roller 26 of the second developing unit 20B, the magnetic field intensity is distributed such as represented by a dashed line in FIG. 6; the magnetic fields developed by the magnets $P_4$ and $P_5$ is shielded by the shield plate 48 while, at the same time, the paddle roller 28 is prevented from scooping up the toner. In this condition, therefore, the first developing unit 20A performs ordinary development, but no toner is supplied to the developing roller of the second developing unit 20B and, hence, no toner is transferred from the unit 20B to the photoconductive drum 10.

It is to be noted that, when a power switch of the copier is turned on, the above-described developing procedure begins after the sleeve 44 and, if necessary, the paddle roller 28 have been driven with the shield plate 48 held in the development starting position so as to fully remove the toner from the sleeve 44.

Immediately after the development by the first developing unit 20A has been completed, the stepping motors individually associated with the shield plates 48 are energized so that the shield plate 48 of the first developing unit 20A and the shield plate 48 of the second developing unit 20B are transported to the toner scooping position and the residual toner separating position, respectively. This stops the toner supply to the magnetic brush in the first unit 20A and prepares the second unit 20B for the start of development. Since the removal of toner effected by each shield plate 48 completes within 0.5 second, the shield plate 48 may be driven at a relatively low speed. Low speed drive of the shield plate 48 would enhance durability and reduce the load.

When a predetermined time expires after the transport of the shield plates 48 to their predetermined positions as stated above, the paddle roller 28 of the first developing unit 20A is brought to a halt while, at the same time, the paddle roller 28 of the second developing unit 20B is driven. In this manner, the paddle roller 28 continues its rotation for the predetermined period of time even after the stop of developing operation. Hence, in the first developing unit 20A, toner remaining on the developing roller 26 is returned toward the paddle roller (arrow C in FIG. 1) without accumulating between the developing roller 26 and the paddle roller 28 (portion B in FIG. 1), by the motion of the paddle roller 28 after the end of development. Under this condition, a smooth flow of toner is insured so that the developing roller 26 is prevented from spattering the residual toner to in turn effectively prevent the toner from being retransported toward the drum 10. It is to be noted that the retransport of toner toward the drum 10 can be eliminated if the toner spattering height by the developing roller 26 is maintained lower than a predetermined height (point A in FIG. 1).

When the second developing unit 20B is driven as stated above, it performs a similar operation by using toner of another color. In this case, the sleeve 44, paddle roller 28 and transport screw 34 of the second unit 20B begin to be operated immediately before the start of development by the second unit 20B (e.g. 2 seconds before the start of development). Immediately after this, the stepping motor or the like associated with the shield plate 48 is energized to move the shield plate 48 to its predetermined position. As the shield plate 48 arrives at the predetermined position, the feeler 76 covers the position sensor 78 or 80 with its tip so that the position sensor 78 or 80 produces a detection signal. In response to this signal, the shield plate 48 is stopped at that particular position.

In a repeat copy mode, the procedure described above is repeated.

While in the above embodiment the paddle roller 88 is brought to a halt to interrupt the toner scooping operation, it may be decelerated after development to prevent the toner from being spattered beyond the predetermined point A, FIG. 1. Such an alternative arrangement, too, is effective to prévent the toner from remaining in the portion B, FIG. 1, between the developing roller 26 and the paddle roller 28, thereby insuring a smooth flow of toner. The deceleration of the paddle roller 28 may be effected by, for example, lowering the voltage applied to a DC drive motor. Whether to stop the paddle roller 28 or to decelerate it depends upon the positional relationship and cost.

While the sleeve 44 of the developing roller 26 should only be rotated during development and immediately before and after it, it may be constantly rotated as indicated by a dashed line in FIG. 5.

When a copy down condition occurs due to some trouble, it is advantageous to return the shield plate 48 to a predetermined home position so that the magnetic brush may loose its nap.

Figure 7:
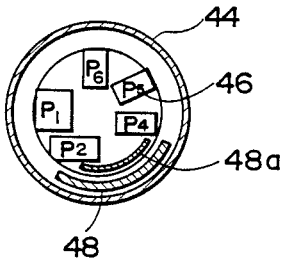
FIG. 7 is a section showing another specific construction of the developing roller in accordance with the present invention.

In the case that simply transporting the shield 48 causes the magnetic fields developed by the magnets $P_2$ and $P_3$ to be noticeably intensified, a double shield structure such as shown in FIG. 7 may be adopted. Specifically, in FIG. 7, a small-size magnetic shield plate 48*a* is interposed between the magnets $P_2$ and $P_4$ and radially inward of the shield plate 48 which is to be transported. The double shield structure of FIG. 7 eliminates the difficulty ascribable to the magnetic forces of the magnets $P_2$ and $P_3$ which are intensified when the magnets $P_4$ and $P_5$ are shielded.

Figure 8:
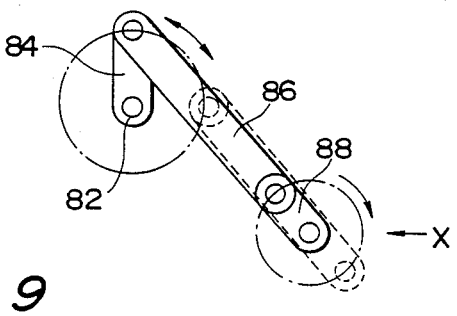
FIG. 8 is a side elevation showing another specific construction of a drive system which is associated with a shield plate that is rotatable in the developing roller.
Figure 9:
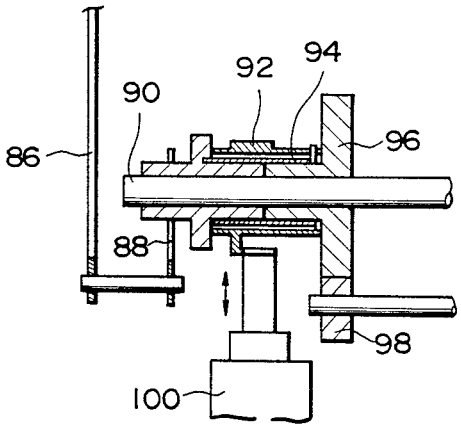
FIG. 9 is a section as seen in a direction X of FIG. 8.

Referring to FIGS. 8 and 9, an alternative arrangement for driving the shield plate 48 is shown. As shown, a crank arm 84 is fixed to a rotary shaft 82 of the shield plate 48. A connecting rod 86 is connected at one end to the free end of the crank arm 84 by a pin and at the other end to a drive shaft 90 through a crank arm 88. The drive shaft 90 is connected to intermeshing gears 96 and 98 through a sleeve clutch 92 and a spring clutch 94. The gear 98 is mounted on a drive shaft which is associated with the paddle roller 28. A solenoid 100 is disposed in the vicinity of the sleeve clutch 92. Every time two stops which are provided on the sleeve clutch 92 approach the tip of the solenoid 100, the rotation is interrupted on a half-rotation basis, whereby the shield plate 48 is reciprocally moved. While the rotation is interrupted, the gear 96 slides within the spring clutch 94.

For more accurate positioning, a positioning plate may be provided on the drive shaft 90 in addition to the two stops. Such a driving system suppresses scattering of toner and reduces the torque required.

Figure 10:
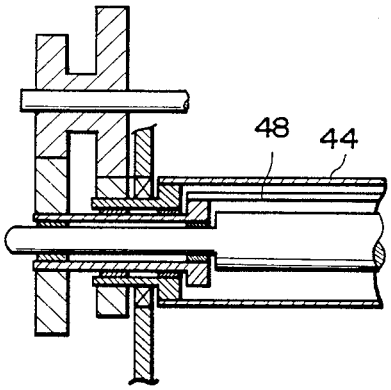
FIG. 10 is a section showing another specific construction of the shield plate drive system.

Referring to FIG. 10, still another embodiment of the present invention is shown. In this particular embodiment, the shaft portion for driving the shield plate 48 and sleeve 44 is provided with a doubled structure. Specifically, the drive shaft portion of the shield plate 48 is connected to an intermediate point of the drive gear which is associated with the sleeve 44. In this case, the spring clutch 94 previously stated may be installed in the intermediate point of the drive gear to effect the predetermined positioning.

Further, an electromagnetic reversible clutch or the like may be used for implementing the movement of the shield plate 48 along the arcuate path.

Figure 11:
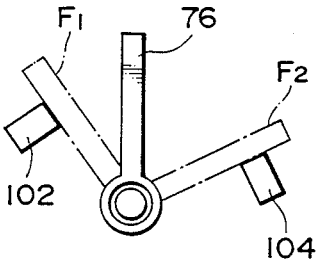
FIG. 11 is a diagram showing means for stopping the movement of the shield plate.
Figure 12:
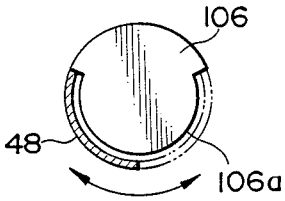
FIG. 12 is a view showing another specific construction of the means for stopping the movement of the shield plate.

FIGS. 11 and 12 each shows another specific arrangement for stopping the feeler 76. In FIG. 11, stops 102 and 104 are located at, respectively, the maximum angular positions $F_1$ and $F_2$ of the feeler 76 so as to stop the angular movement of the feeler 76 in abutment thereagainst. A sensor is associated with each of the stops 102 and 104 to delivering a stop signal to, for example, a DC motor adapted to drive the shield plate 48. When the feeler 76 abuts against any of the stops 102 and 104, the sensor associated with that stop produces a stop signal for deenergizing the DC motor.

Figure 13:
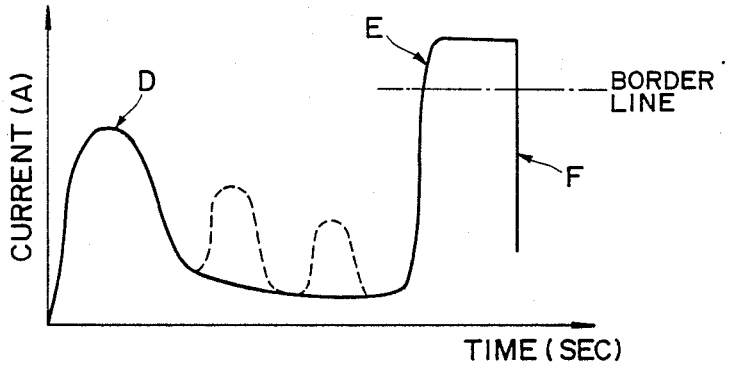
FIG. 13 is a graph showing a variation of current which flows through a drive motor associated with the shield plate.

As shown in FIG. 13, the above-mentioned DC motor is energized upon the lapse of a predetermined period of time after the abutment of the feeler 76 against the stop 102 or 104. Specifically, FIG. 13 shows the variation of current (ordinate) which flows through the DC motor with respect to time (abscissa). As shown, current of a relatively high level flows through the DC motor at the time of start of the shield plate 48 (portion D) and, thereafter, it settles at lower levels. As the feeler 76 is brought to a halt in abutment against the stop 102 or 104, a substantial current is caused to flow through the DC motor (portion E) and, when a predetermined period of time expires, the DC motor is deenergized (portion F). To eliminate the fear thatn an excessive current flows through the DC motor at the instant of stop of the feeler 76, a limiter may be used which prevents currents higher than a particular level as indicated by a dash-and-dot line in FIG. 13 from flowing. This eliminates the need for turning off the DC motor. When the shield plate 48 moves past any magnet, the current is increased as indicated by a dashed line in FIG. 13.

In the above construction, a mechanism for preventing the DC motor from being rotated in the reverse direction is necessary. Such a mechanism may be implemented with increasing the speed reduction ratio of the motor or by short-circuiting and, thereby, locking the DC motor.

In FIG. 12, the magnetic body comprises a magnet roll 106 which is provided with a recess **106*a* except for a part of its outer periphery. Having an arcuate section, the recess 106*a* accommodates the shield plate 48 therein. The recess 106*a* has a length which covers the angular range of movement of the shield plate 48, i.e., a length which is approximately two times greater than that of the shield plate 48. In this configuration, the shield plate 48 is movable in and along the recess 106*a*. The shield plate 48 is positioned when one of its opposite ends abuts against one of opposite walls of the magnet roll 106 which define the recess 106*a***.

The embodiment shown in FIG. 12 provides the developing device with a more compact configuration. Specifically, the larger diameter portion of the magnet roll 106 which lacks the recess **106*a* should be provided with a larger radius than the other portion and with a substantial area in order to enhance the deposition of a developer. In this embodiment, the recess 106*a* is located in that portion of the magnet roll 106 which needs only a small diameter, and the shield plate 48 is received in the recess 106*a* in a compact configuration. This, coupled with the fact that the feeler and others included in the foregoing embodiments are absent, further promotes the compact construction. The absence of the feeler 76 which selectively abuts against the stops 102 and 104** is advantageous from the strength viewpoint as well and, yet, eliminates failures of the position sensors and others to remarkably improve the reliability of operation. No doubt, this kind of embodiment is similarly applicable to a magnetic body in a form of blocks.

Figure 14:
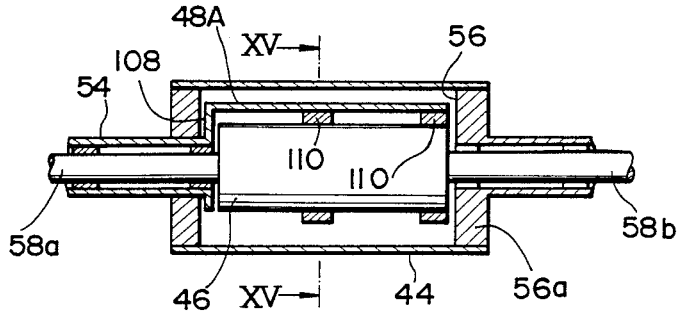
FIG. 14 is a section showing another embodiment of the present invention which includes support members for the shield plate.
Figure 15:
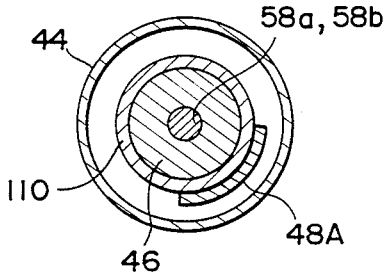
FIG. 15 is a section along line XV—XV of FIG. 14.

Referring to FIGS. 14 and 15, a farther embodiment of the present invention is shown. This embodiment differs from those of FIGS. 1 and 3 in that a shield plate 48A corresponding to the shield plate 48 is integrated with the first drive shaft 54 by an arm 108, and in that one or more shield plate support members 110 are disposed between the magnetic body 46 and the shield plate 48A for supporting the shield plate 48A. The arm 108 may comprise an end portion of the shield member 48A which is shaped by bending or a steel sheet which is substantially equal in thickness to the shield plate 48A and welded to the shield plate 48A and first drive shaft 54. The arm 108 and first drive shaft 54 may be provided in only one end portion of the shield plate 48A as shown or in both end portions as the case may be.

The shield plate support members 110 are each made of a non-magnetic material such as non-magnetic stainless steel or plastics. Preferably, the support members 110 are made of oreoresin such as oreopolyacetal in order to allow a minimum of resistance to the relative rotation of the magnetic body 46 and shield plate 48A to occur. As shown in FIG. 15, when the magnetic body 46 is a roll, all that is required is locating the shield plate support members 110 in at least the angular range of movement of the shield plate 48A. To support the shield plate support members 110, the support members 110 may be bonded to either one of the shield plate 48A and magnetic body 46 or, as shown in FIG. 15, mated with the outer periphery of the roller type magnetic body 46. So far as the arrangement of FIG. 15 is concerned, a single support member 110 may be provided to cover the entire width of the magnetic body 46 or, as shown in FIG. 14, a plurality of support members 110 may be provided only at the intermediate and free end portions of the shield plate 48A. In the case that the shield plate 48A is supported by a pair of arms 54B at both ends thereof, it may be supported by a single support member 110 at the intermediate portion only.

Figure 16:
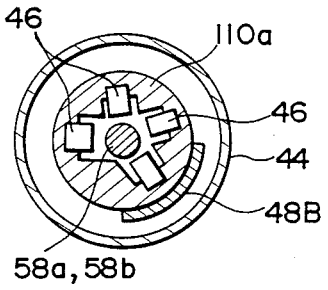
FIG. 16 is a section showing another embodiment which includes support members for the shield plate.

Magnets presently used to implement the magnetic body 46 take the form of a roll or that of a block. Since roll magnets and block magnets are different in peak gauss amount, half-width, magnetic force distribution and others, the use of block magnets for the magnetic body 46 is unavoidable depending upon the situation. When the magnetic body 46 takes the form of blocks, as shown in FIG. 16, the blocks may be molded integrally with a shield plate support member **110*a* which is made of oreoresin or, alternatively, there may be performed the steps of fixing the individual blocks 46 to a support shaft 58*a* or 58*b*, machining the outer peripheries of the blocks 46 to provide them with an arcuate configuration, and coupling the annular shield plate support member 110*a* over those outer peripheries of the blocks 46**.

In summary, it will be seen that in accordance with the present invention a magnetic shield plate for shielding a magnetic field is received in a developer carrier to be movable in a reciprocal motion to variably control the intensity of a magnetic field adapted to develop a magnetic brush and the amount of toner to be scooped. Hence, the toner supply from a developing unit which is not operated is surely inhibited by an extremely simple construction. Especially, when the present invention is applied to multi-color development, different colors are prevented from being mixed together to promote quality reproduction.

Also, in accordance with the present invention, toner on the developer carrier is fully removed every time a developing cycle is completed. This eliminates the elevation of pressure inside the developing unit and, thereby, the scattering of toner.

Still another advantage attainable with the present invention is that since the shield plate is positioned by stop means, it is surely moved in a reciprocal motion to attain remarkable reliability.

Furthermore, in accordance with the present invention, the shield plate is supported by a shaft of a magnetic body through an arm which is substantially equal in thickness to the shield plate, and a non-magnetic shield plate support member or members are interposed between the shield plate and the magnetic body. Such a construction allows the various structural elements to be positively supported by an axis which is stable and, yet, cuts down the length of a developing sleeve as well as the torque necessary for driving the shield plate, thereby simplifying the construction, reducing the cost, and facilitating the assembly.

Various modifications will become possible for those skilled in the art after receiving the teachings of the present disclosure without departing from the scope thereof.

What is claimed is:

1. A device disposed in close proximity to latent image carrier of an image forming apparatus for carrying a developer which constitutes a magnetic brush, comprising:

a cylindrical sleeve for supporting said magnetic brush an on outer periphery of said cylindrical sleeve, said sleeve including a portion at a first position where said sleeve scoops the developer and a portion at a second position where the developer is separated therefrom;

magnetic field developing means disposed in said sleeve for developing magnetic fields for forming said magnetic brush; and a shield member located in a space which is defined between said sleeve and said magnetic field developing means such that said shield member is movable in a reciprocal motion between said first position and said second position, said shield member shielding a part of said magnetic field.

2. A device as claimed in claim 1, further comprising sensor means for sensing arrival of said shield member at each of said first and second positions.

3. A device as claimed in claim 1, further comprising shield member stopping means for stopping said shield member at each of said first and second positions.

4. A device as claimed in claim 1, wherein said magnetic field developing means comprises a main pole magnetic body for development located to face said latent image carrier, and auxiliary pole magnetic bodies for scooping the developer onto said sleeve.

5. A device as claimed in claim 4, wherein said main pole magnetic body is located in a position outside of a region which is defined between said first and second positions.

6. A device as claimed in claim 1, further comprising non-magnetic, shield member support means disposed between said magnetic field developing means and said shield member for supporting said shield member.

7. A device as claimed in claim 6, wherein said shield member support means is made of oreoresin.

8. A device as claimed in claim 6, wherein said shield member support means supports said shield member at at least an intermediate and a free end portion of said shield member.

9. A device as claimed in claim 6, wherein said magnetic field developing means comprises magnetic bodies in a form of blocks, said shield member support means supporting said blocks.

10. A developing unit located in close proximity to a latent image carrier of an image forming apparatus, comprising:

magnetic brush forming means for forming a magnetic brush means, said magnetic brush forming means comprising a cylindrical sleeve for supporting said magnetic brush on an outer periphery of said cylindrical sleeve, magnetic field developing means disposed in said sleeve for developing magnetic fields for forming said magnetic brush, and a shield member located in a space which is defined between said sleeve and said magnetic field developing means such that said shield member is movable in a reciprocal motion between a first position corresponding to that where said sleeve scoops the developer and a second position corresponding to that where said developer is separated, said shield member shielding a part of said magnetic fields at said first and second positions, and scooping means for supplying the developer to said first position on said sleeve of said magnetic brush forming means.

11. A developing unit as claimed in claim 10, further comprising scoop control means for controlling an amount of developer which is scooped by said scooping means.

12. A developing unit as claimed in claim 11, wherein said scoop control means reduces the amount of developer while said developing unit is not operated for development.

13. A developing unit as claimed in claim 10, wherein said magnetic field developing means comprises a main pole magnetic body for development located to face said latent image carrier, and auxiliary pole magnetic bodies for scooping the developer onto said sleeve.

14. A developing unit as claimed in claim 13, wherein said main pole magnetic body is located in a position outside of a region which is defined between said first and second positions.

15. A developing unit as claimed in claim 10, wherein said scooping means comprises a rotary paddle roller.

16. A developing unit as claimed in claim 15, wherein said paddle roller is located at a position and rotated at a speed which prevent the developer from being transported to an uppermost portion of said sleeve when said shield member shields the magnetic field at said first position.

17. In a developing device having at least one developing unit which is located in close proximity to a latent image carrier of an image forming apparatus, said developing unit comprising magnetic brush developing means for developing a magnetic brush by carrying a developer on said magnetic brush forming means, said magnetic brush forming means comprising a cylindrical sleeve for supporting said magnetic brush on an outer periphery of said cylindrical sleeve, magnetic field developing means disposed in said sleeve for developing magnetic fields for forming said magnetic brush, and a shield member located in a space which is defined between said sleeve and said magnetic field developing means such that said shield member is movable in a reciprocal motion between a first position corresponding to that where said sleeve scoops the developer and a second position corresponding to that where said developer is separated, said shield member shielding a part of said magnetic fields at said first and second positions, and scooping means for supplying the developer to said first position on said sleeve of said magnetic brush forming means.

18. A developing unit as claimed in claim 17, wherein said magnetic field developing means comprises a main pole magnetic body for development located to face said latent image carrier, and auxiliary pole magnetic bodies for scooping the developer onto said sleeve.

19. A developing unit as claimed in claim 18, wherein said main pole magnetic body is located in a position outside of a region which is defined between said first and second positions.

20. In a multiple color developing device having a plurality of developing units which are located in close proximity to a latent image carrier of an image forming apparatus, each of said developing units comprising magnetic brush forming means for forming a magnetic brush by carrying a developer on said magnetic brush developing means, said magnetic brush forming means comprising a cylindrical sleeve for supporting said magnetic brush on an outer periphery of said cylindrical sleeve, magnetic field developing means disposed in said sleeve for developing magnetic fields for forming said magnetic brush, and a shield member located in a space which is defined between said sleeve and said magnetic field developing means such that said shield member is movable in a reciprocal motion between a first position corresponding to that where said sleeve scoops the developer and a second position corresponding to that where said developer is separated, said shield member shielding a part of said magnetic fields at said first and second positions, and scooping means for supplying the developer to said first position on said sleeve of said magnetic brush forming means.

21. A developing unit as claimed in claim 20, wherein said magnetic field developing means comprises a main pole magnetic body for development located to face said latent image carrier, and auxiliary pole magnetic bodies for scooping the developer onto said sleeve.

22. A developing unit as claimed in claim 21, wherein said main pole magnetic body is located in a position outside of a region which is defined between said first and second positions.

* * * * *